United States Patent [19]

Mirhej

[11] 4,155,214

[45] May 22, 1979

[54] YARN PRODUCT AND PROCESS

[75] Inventor: Michael E. Mirhej, Signal Mountain, Tenn.

[73] Assignee: E. I. Du Pont de Nemours and Company, Wilmington, Del.

[21] Appl. No.: 842,077

[22] Filed: Oct. 14, 1977

[51] Int. Cl.[2] ..... D02G 1/02; D02G 3/04

[52] U.S. Cl. ..... 57/244; 57/282

[58] Field of Search ..... 57/140 R, 140 BY, 157 R, 57/157 TS, 157 MS

[56] References Cited

U.S. PATENT DOCUMENTS

| | | | |
|---|---|---|---|
| 3,593,513 | 7/1971 | Reese | 57/140 BY |
| 3,874,160 | 4/1975 | Kitazawa et al. | 57/140 BY X |
| 3,998,042 | 12/1976 | Reese | 57/140 BY |
| 4,025,595 | 5/1977 | Mirhej | 264/103 |

FOREIGN PATENT DOCUMENTS

| | | |
|---|---|---|
| 14585 | 4/1971 | Japan. |
| 25842 | 3/1975 | Japan. |
| 47164 | 4/1976 | Japan. |
| 1166247 | 10/1969 | United Kingdom. |

OTHER PUBLICATIONS

Chemiefusern/Textilindustrie, vol. 27/79, Feb. 1977, pp. 149–153, Fresco, N. Jour. & Jamm.

*Primary Examiner*—Donald Watkins

[57] ABSTRACT

A twist-free texturing feed yarn of drawn thermoplastic filaments is prepared from a bundle (A) of filaments having a melting point of 255° to 275° C. and a bundle (B) of filaments having a melting point above 230° C. which is 15° to 39° C. lower than that of the filaments of bundle (A). The bundles differ in coloration or affinity for dyestuffs. The feed yarn is false-twist textured at a temperature 53° to 78° C. lower than the melting point of the filaments of bundle (A) to produce a textured yarn which provides a heather of high contrast and low directionality (no color streaks) in fabric made from the yarn. Filament compositions illustrated are poly(ethylene terephthalate) or poly[ethylene terephthalate/5-(sodium sulfo)isophthalate] or poly(hexamethylene adipamide) for bundle (A); and poly(ethylene terephthalate/glutarate) or poly(ethylene terephthalate/adipate) or poly(ethylene/2,2-dimethyl-1,3-propylene terephthalate) for bundle (B).

9 Claims, 6 Drawing Figures

YARN PRODUCT AND PROCESS

BACKGROUND OF THE INVENTION

This invention relates to a twist-free texturing feed yarn of drawn thermoplastic filaments which differ in coloration or affinity for dyestuffs to obtain heather effects in fabrics. The invention is more particularly concerned with a yarn and a process for producing textured yarn which will provide a high contrast heather of low directionality or no directionality in fabrics.

Reese U.S. Pat. No. 3,593,513 discloses cospinning filaments of poly(ethylene terephthalate) and poly[ethylene terephthalate/5-(sodium sulfo)isophthalate] (98/2), or poly(hexamethylene adipamide), combining the filaments into a single composite yarn, drawing the filaments as an integral yarn, and further treating the drawn yarn to yield a finished yarn. False-twist texturing is mentioned. The patent teaches that the drawn yarn must have a degree of filament intermingling (DFI) of at least 65 percent and a difference in break elongation not exceeding 15 percent between the two types of filaments. A low contrast heather of low directionality is obtained when fabric made from the yarn is dyed with suitable dyes. For example, the poly(ethylene terephthalate) filaments can only be dyed with disperse dyes, the poly[ethylene terephthalate/5-(sodium sulfo)isophthalate] filaments can be dyed with disperse and basic dyes, and the poly(hexamethylene adipamide) filaments can be dyed with acid dyes.

Contrast refers to the ease with which the eye can distinguish between different colors in a fabric. At maximum filament intermingling, the different colors will appear to blend and provide a substantially uniform color. The Reese patent discloses a method of measuring the degree of filament intermingling (DFI). For the filament counts disclosed a DFI value of about 40 percent indicates no intermingling of the two types of filaments and 100 percent indicates the maximum obtainable filament intermingling.

A high contrast heather, corresponding to a DFI value of about 40 to about 60 percent, is desirable for many purposes. Mirhej U.S. Pat. No. 4,025,595 discloses that a moderately high contrast can be obtained by cospinning the two types of filaments into separate filament bundles, separately entangling each bundle to reduce subsequent filament intermingling between the bundles, drawing the bundles together to form a drawn yarn, and then passing the yarn through an interlacing jet to provide a DFI value of 60 to 63 percent. As shown in FIG. 3 of the patent, the interlace jet intermittently entangles the filament bundles together at cross-over points, the distance between which determines the directionality obtained in a fabric. Directionality refers to substantially parallel streaks of color formed between cross-over points by the separate bundles. The patent discloses that fabrics having average streak lengths of 0.5 to 1.5 cm have low directionality, fabrics having average streak lengths of 1.6 to 3 cm have medium directionality, and fabrics having average streak lengths greater than 3 cm have high directionality. The moderately high contrast heather provided by the process of that patent is accompanied by a medium to high directionality, even when the yarns are false-twist textured.

High contrast heather with low directionality has been provided by doubling two types of drawn filament bundles with true twist to provide a twisted yarn having a sufficient number of bundle cross-over points for low directionality. However, introduction of true twist is a low-speed process. It is desirable to avoid the expense of this additional operation.

SUMMARY OF THE INVENTION

The present invention is a twist-free texturing feed yarn of drawn thermoplastic filaments of about the same denier, and a process for texturing the yarn, for providing high contrast heather of low directionality in fabric made from the textured yarn. Production of the yarn does not involve true twisting and is sufficiently inexpensive that the yarn may be used practically in any desired end use.

The feed yarn comprises a bundle (A) of 6 to 50 filaments having a melting point of 255° to 275° C. (preferably 263° to 273° C.), and a bundle (B) of 6 to 50 filaments having a melting point above 230° C. (preferably 232° to 248° C.) which differs from that of the filaments of bundle (A) by 15° to 39° C. The filaments of bundle (A) are substantially free of filament intermingling with the filaments of bundle (B) and have a coloration or affinity for dye-stuffs different from that of the filaments of bundle (B) for obtaining a high contrast heather effect in fabrics. Preferably, the yarn has a DFI value of about 40 to about 60 percent.

Preferably the filaments of bundle (A) consist of poly(ethylene terephthalate) or poly[ethylene terephthalate/5-(sodium sulfo)isophthalate] containing up to about 2 mole percent of the 5-(sodium sulfo)isophthalate groups in the polymer chain; and the filaments of bundle (B) consist of a polymer of about 85 to 90 mole percent of ethylene terephthalate structural units and about 10 to 15 mole percent of other ester units forming a copolyester therewith. An all-polyester yarn is preferred over one containing poly(hexamethylene adipamide) filaments in bundle (A). Filaments of poly[ethylene terephthalate/5-sodium sulfo)isophthalate] are generally preferred over filaments of poly(ethylene terephthalate), because of the ease of dyeing them to a color different from the filaments of bundle (B). However, 5-(sodium sulfo)isophthalate units can be included in the ester units of the filaments of bundle (B).

Preferably, the filaments of bundle (B) consist of poly(ethylene terephthalate/glutarate) or poly(ethylene terephthalate/adipate) or poly(ethylene/2,2-dimethyl,1-3-propylene terephthalate).

The process for producing a textured yarn that provides a high contrast heather of low directionality comprises combining a bundle (A) of 6 to 50 drawn filaments having a melting point of 255° to 275° C. with a bundle (B) of 6 to 50 drawn filaments having a melting point above 230° C. which differs from that of the filaments of bundle (A) by 15° to 39° C., the combined bundles forming a texturing feed yarn which is substantially free from twist or intermingling of the two types of filaments, and then false-twist texturing the feed yarn at a texturing temperature 53° to 78° C. lower than the melting point of the filaments of bundle (A) to produce a textured yarn, substantially free from fusion or breakage of filaments, that has twist entrapments alternating with short untwisted sections of yarn along the length of the yarn.

Preferences as to the texturing feed yarn used have been recited previously. The texturing feed yarn is preferably false-twist textured at about 710 $D^{-0.5}$ turns per inch (28000 $D^{-0.5}$ turns/meter) at a texturing temperature which causes a high frequency of twist entrapments in the yarn, D being the yarn denier.

BRIEF DESCRIPTION OF THE DRAWING

FIG. 4 illustrates high constrast with high directionality. FIG. 5 illustrates high contrast with acceptably low directionality. FIG. 6 illustrates high contrast with preferred non-directionality.

DETAILED DESCRIPTION

The twist-free texturing feed yarn is composed of two drawn filament bundles which differ in coloration or can be dyed in combination to show a difference in coloration. The filaments of one bundle can be colored by incorporating carbon black or other pigment in the polymer melt prior to spinning into filaments. Polyester filaments containing 5-(sodium sulfo)isophthalate units in the polymer chain to provide dyeability with basic dyes can be dyed to colors different from polyester filaments which can be dyed only with disperse dyes. Polyamide filaments can be dyed with acid dyes to a different color than polyester filaments.

Figure 1:
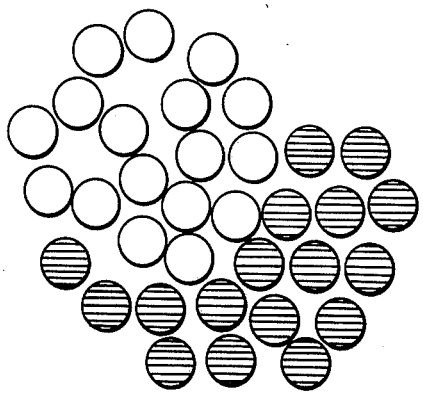
FIG. 1 shows, at considerable enlargement, a transverse cross-sectional view of one embodiment of texturing feed yarn of this invention.

In order to obtain a high contrast in fabrics made from the yarn, the filaments of different coloration or affinity for dyestuffs must be combined so that there is substantial freedom from filament intermingling between the two types of filaments. FIG. 1 illustrates a preferred arrangement with the two types of filaments in separate bundles assembled side-by-side. The yarn may be lightly interlaced for winding a good package, as in conventional yarn production, provided that intermingling of the two types of filaments is substantially avoided. Preferably, the yarn has a DFI value, determined as described in U.S. Pat. No. 3,593,513, of about 40 to about 60 percent. The color contrast decreases as the DFI value of the yarn increases.

In order to obtain low directionality in fabrics made from the yarn after it has been false-twist textured, the two types of filaments must differ in melting point by 15° to 39° C. and the texturing temperature must be at a suitable temperature lower than the melting point of either type of filament. Suitable melting point and texturing temperatures for obtaining textured yarn which provides low directionality, a good level of crimp and good bulk in fabrics will become clear from the process invention for producing the textured yarn.

Figure 2:
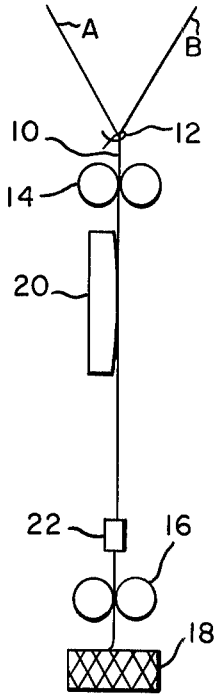
FIG. 2 is a schematic illustration of a continuous process for producing a textured yarn from two bundles of drawn filaments.

As shown schematically in FIG. 2, a bundle (A) of one type of drawn filaments is combined with a bundle (B) of the other type of drawn filaments to form feed yarn 10 at guide 12. The feed yarn is conducted through a conventional false-twist texturing machine by feed rolls 14 and forwarding rolls 16, and is then wound into a package 18. As is well known, the rolls 14 and 16 may be driven at the same speed, or may be driven at different speeds to provide overfeed or slight underfeed through the texturing zone of the machine. In the texturing zone, the yarn is heated by a conventional heating device, such as the hot plate 20 shown, and then passes through false-twister 22 which backs up twist in the yarn passing over the hot plate 20 or other heater. The twist becomes set in the yarn as it cools during passage from the heater to the false-twister, and the yarn untwists as it passes from the false-twister to forwarding rolls 16. Any of the conventional spindle or friction-type false-twisters may be used.

The false-twist texturing machine is usually operated at a yarn speed and a false-twister speed (RPM) which will provide about 710 $D^{-0.5}$ turns per inch (28000 $D^{-0.5}$ turns/meter) of inserted twist where D is the denier of the feed yarn. For polyester yarns and yarns of poly(hexamethylene adipamide) a good level of crimp and bulk can be provided at a texturing temperature ranging from 190° C. up to a temperature at which filament fusion or breakage becomes objectionable. The texturing feed yarn of the present invention comprises a bundle (A) of 6 to 50 filaments having a melting point of 253° to 275° C. and a bundle (B) of 6 to 50 filaments having a melting point above 230° C. which differs from that of the filaments of bundle (A) by 15° to 39° C.

Illustrations of filaments having suitable melting points for bundle (A) include filaments of poly(ethylene terephthalate), 273° C., filaments of poly[ethylene terephthalate/5-(sodium sulfo)isophthalate] containing about 2 mole percent of the 5-(sodium sulfo)isophthalate groups in the polymer chain, 263° C., and filaments of poly(hexamethylene adipamide), 272° C. Illustrations for bundle (B) include filaments of a polymer of about 85 to 90 mole percent ethylene terephthalate structural units and about 10 to 15 mole percent of other ester units forming a copolyester therewith, such as filaments of poly(ethylene terephthalate/glutarate), 232° to 238°, poly(ethylene/2,2-dimethyl-1,3-propylene terephthalate), 242° C., or poly(ethylene terephthalate/adipate), 248° C.

Figure 3:
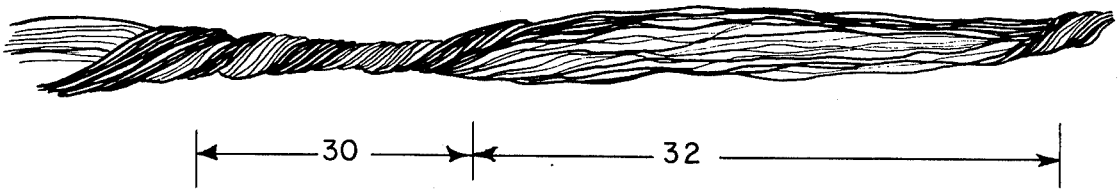
FIG. 3 shows, at considerable enlargement, a schematic illustration of a portion of a yarn immediately after false-twist texturing in accordance with this invention.

The feed yarn of this invention is textured at a temperature within the range of 53° to 78° C. lower than the melting point of the filaments of bundle (A) which produces a textured yarn, substantially free from fusion or breakage of filaments, that provides the desired heather effect in fabrics made from the yarn. As the texturing temperature is increased toward the above-specified temperature, a threshold temperature is reached at which tightly twisted short lengths of yarn slip through the false-twister and remain in the untwisted yarn as twisted sections designated "twist entrapments." FIG. 3 illustrates a twist entrapment 30 followed by an untwisted yarn section 32 which extends to the next twist entrapment. The onset of this formation of twist entrapments coincides with the beginning of a reduction of directionality in fabrics made from the textured yarn. As the texturing temperature is increased above the threshold temperature, the frequency of twist entrapments in the yarn increases and the directionality of heather decreases in fabrics made from the yarn. For the feed yarn of this invention, a desirable high contrast heather of low directionality is obtained at a texturing temperature with the range of 53° to 78° C. below the melting point of the filaments of bundle (A), e.g., at a texturing temperature of about 195° to 220° C. when bundle (A) consists of poly(ethylene terephthalate) or poly(hexamethylene adipamide) filaments.

Production of a textured yarn which will provide low directionality, a good level of crimp and good bulk in fabrics made from it, is obtained when the melting points of the two types of filaments differ by 15° to 39° C. If the melting point of the filaments of bundle (B) is too low, low directionality occurs at a texturing temperature which is too low to impart a good level of crimp and bulk to the filaments of bundle (A), and increasing the temperature enough to provide satisfactory crimp and bulk will fuse the filaments of bundle (B) to an extent which will cause undesirable stiffness and boardiness in fabrics. On the other hand, if the melting point of the filaments of bundle (B) is too high, low directionality will not be obtained at suitable texturing temperatures for producing textured yarn without breakage. Suitable texturing temperatures are at least 53° C. below the melting point of the filaments of bundle (A) because filament softening at higher temperatures causes excessive broken filaments or texturing breaks (broken yarn).

EXAMPLE 1

A 70 denier bundle (A) of 17 drawn filaments of poly(ethylene terephthalate) is combined with a 70 denier bundle (B) of 17 drawn filaments of poly(ethylene terephthalate/glutarate) having a mole ratio of 88.5 terephthalate: 11.5 glutarate and a melting point of 238° C. The filaments of bundle (A) have a melting point of 273° C. and are colored black as extruded by incorporation of carbon black in the melt of poly(ethylene terephthalate). The two bundles are combined to form texturing feed yarns which are substantially free from twist or intermingling of the two types of filaments. The DFI value of the yarns is about 45%.

Figure 4:
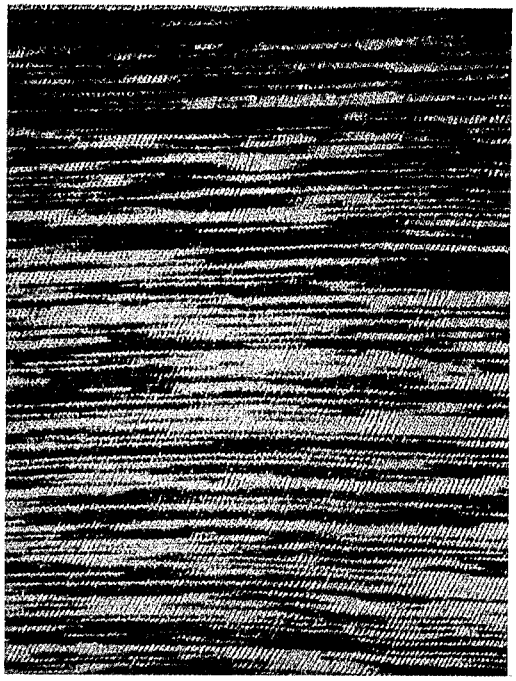
FIGS. 4, 5 and 6 are photographs showing, at low magnification, knitted fabrics of textured yarns produced as described in Example 1.
Figure 5:
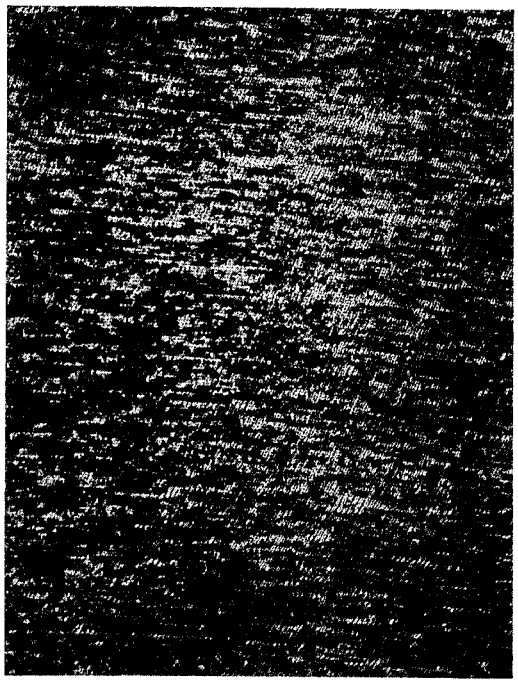
Figure 6:
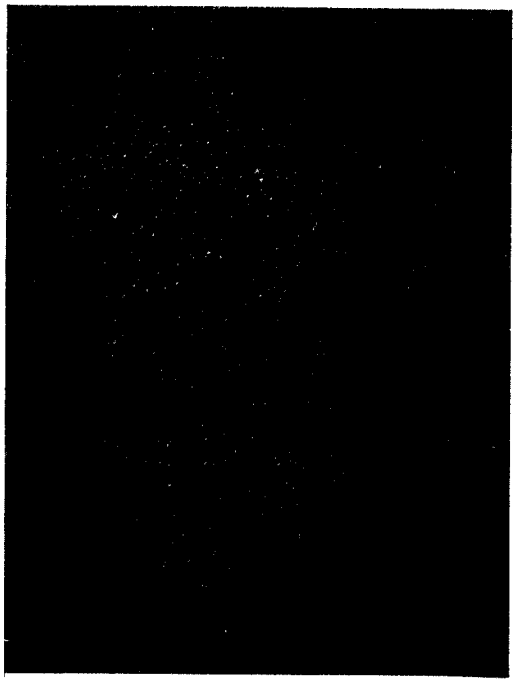

The feed yarns are textured on a Leesona® 955 false-twist texturing machine operated at 300 feet per minute (91.4 meters per minute) and 60 turns per inch (2360 turns/meter) of inserted twist, using texturing temperatures of 190°, 205°, 210° and 220° C. Single-knit tubings are prepared from the yarns on a Model 68 Lawson-Hemphill Fiber Analysis Knitter fitted with a 3.5 inch (8.9 cm) head and operated at a feed rate setting of 4.5 (8:1 gear ratio). A high contrast heather with good crimp and good bulk is provided by the yarns textured at temperatures of 190°, 205° and 210° C. At a texturing temperature of 220° C. sufficient filament fusion occurs to render the fabric harsh and boardy. At 190° C. the heather effect is undesirably directional as shown in FIG. 4. At 205° C. reduced directionality results as shown in FIG. 5, and a twist entrapment frequency of 1 per 40 inches (100 cm) is observed. At 210° C. a very fine, non-directional, high contrast heather results as shown in FIG. 6. A twist entrapment frequency of 1 per 4 inches (10 cm) is observed. The DFI value of the textured yarns is about 50%.

EXAMPLE 2

The procedure of Example 1 is repeated except that bundle (B) consists of 17 drawn filaments of poly(ethylene/2,2-dimethyl-1,3-propylene terephthalate) having a mole ratio of 90 ethylene: 10 of the 2,2-dimethyl-1,3-propylene and a melting point of 242° C. The DFI values are about 45% for the feed yarn and about 55% for the textured yarn. The twist entrapment frequency in the textured yarns is zero at 190° and 205° C., 1 per 50 inches (127 cm) at 210° C., and 1 per 7 inches (18 cm) at 220° C. texturing temperature. In all four textured yarns the crimp frequency for the filaments of bundle (B) is about 15 per inch (6/cm), based on the straightened length, but for the filaments of bundle (A) the crimp frequency increases from 17 per inch (7/cm) at 190° C. to about 26 per inch (10 cm) at 220° C. A high contrast heather with good crimp and bulk is provided in fabrics of each yarn. The heather has very high directionality for yarns textured at 190° and 205° C. A high but substantially reduced directionality is provided by the yarn textured at 210° C. Directionality is almost eliminated by the yarn textured at 220° C., providing an appearance intermediate between those of FIGS. 5 and 6.

EXAMPLE 3

The procedure of Example 1 is repeated except that bundle (B) consists of 17 drawn filaments of poly(ethylene terephthalate/adipate) having a mole ratio of 87.5 terephthalate: 12.5 adipate and a melting point of 248° C. The DFI values are about 45% for the feed yarn and about 52% for the textured yarn. The twist entrapment frequency in the textured yarns is zero at 190° C., 1 per 40 inches (102 cm) at 205° C., and 1 per 2 inches (5 cm) at 220° C. Crimp frequency, based on the straightened length, increases from 12 per inch (4.7/cm) to 16 per inch for the filaments of bundle (B), and from 15 per inch (5.9/cm) to 17 per inch (6.7/cm) for the filaments of bundle (A), as the texturing temperature increases from 190° to 220° C. A high contrast heather with good crimp and bulk is provided in fabrics of each yarn. The heather effect is highly directional for yarns textured at 190° to 205° C. (similar in appearance to FIG. 4), but has a greatly reduced directionality for yarn textured at 220° C. (similar in appearance to FIG. 5).

EXAMPLE 4 (Comparison)

The procedure of Example 1 is repeated except that bundle (B) consists of 17 drawn filaments of poly[ethylene terephthalate/5-(sodium sulfo)isophthalate] having a mole ratio of 98 terephthalate:2 of the 5-(sodium sulfo)isophthalate and a melting point of 263° C. The DFI values are about 45% for the feed yarn and 50% for the textured yarn. The twist entrapment frequency in the textured yarns is 0 at 190°, 205° and 220° C., and is 1 per 6 inches (15 cm) at 240° C. texturing temperature. Extremely directional heather effects are obtained in fabrics with yarns textured at 190° to 220° C. (similar in appearance to FIG. 4). Fabrics of yarn textured at 240° C. indicate some reduction in directionality, but less improvement than is shown in FIG. 5. Moreover, the texturing performance at 240° is very poor; there are greater than 100 filament breaks per pound (220/kg) and 4 texturing breaks per pound (about 9/kg).

EXAMPLE 5

This example illustrates cospinning of filament bundles (A) and (B) coupled with simultaneous drawing to provide a texturing feed yarn of this invention. From one half of a spinneret a 13.5 HRV polymer, poly[ethylene terephthalate/5-(sodium sulfo)isophthalate] of 98/2 mole ratio, is melt spun to form a bundle (A) of 17 filaments; and from the other half of the spinneret a 22.1 HRV polymer, of poly(ethylene terephthalate/glutarate) of 86/14 mole ratio, is melt spun to form a bundle (B) of 17 filaments. The spinning temperature of both melts is 290° C. The filaments are quenched in a conventional cross-flow chimney and converged to form the two bundles. The bundles are brought side-by-side for drawing just before passing over feed rolls and are drawn 3.4:1 by draw rolls conveying the yarn at 3504 yards per minute (3204 m/minute). A steam jet is used in the draw zone to assist in drawing the filaments. The drawn feed yarn is then packaged in conventional manner. Bundles (A) and (B) are each 70 denier and the DFI value is about 50–55%, indicating substantial freedom from filament intermingling. The filaments of bundle (A) have a melting point of 263° C., and the glutarate copolymer filaments of bundle (B) have a melting point of 232° C. Separately collected but identically processed bundles exhibit break elongations differing by about 20 percentage units.

The drawn feed yarn is false-twist textured at 190° and 200° C., and formed into single knit tubings by the procedures described in Example 1. The knitted tubings are dyed to a dark shade in a dyebath containing a mixture of three cationic dyes (yellow, red and blue). Only the filaments of bundle (A) become dyed. The yarn textured at 190° C. has a twist entrapment frequency of zero, but fabric made from it appears to show slightly less directionality than that of FIG. 4. The yarn textured at 200° C. has a twist entrapment frequency of 1 per 4 inches (10 cm), and directionality is eliminated in fabric made from it to provide an appearance similar to that of FIG. 6. The fabric has a very fine heather of excellent color contrast. Both yarns provide good crimp and bulk. The crimp frequency for the filaments of bundle (A) is 13 per inch (5.1/cm), and the crimp frequency for the filaments of bundle (B) is 18 per inch (7.1/cm) at 190° C. and 5 per inch (2/cm) at 200° C.

EXAMPLE 6

A 70 denier bundle (A) of 34 drawn filaments of poly(hexamethylene adipamide) having a melting point of 272° C. is combined with a 70 denier bundle (B) of 17 drawn filaments of poly(ethylene terephthalate/glutarate) having a mole ratio of 87.5 terephthalate:12.5 glutarate and a melting point of 233° C. The bundles are combined to form texturing feed yarns which are substantially free from twist or intermingling of the two types of filaments. The feed yarns are false-twist textured at 190°, 200° and 210° C. and formed into single knit tubings by the procedures described in Example 1. The tubings are cross-dyed with red acid dye and blue disperse dye so that the filaments of bundle (A) are red and the filaments of bundle (B) are blue.

The fabric of yarn textured at 190° C. is more than 50% blue with highly directional streaks of red. The fabric of yarn textured at 200° C. is more than 50% red with highly directional streaks of blue. The fabric of yarn textured at 210° C. is greater than 90% red with a fine low-directional heather, but the larger-denier blue filaments of bundle (B) have formed a yarn core which is so completely surrounded by the smaller-denier red filaments of bundle (A) that twist entrapments are found only at infrequent intervals along the yarn.

Test Methods

The polymer melting points given herein are measured in a nitrogen atmosphere with a Du Pont Model 900 Differential Thermal Analyzer (DTA) fitted with chromel/alumel thermocouples and operated at a heating rate of 20° C. per minute. The DTA records the heat flow to the sample per unit time (dh/dt) as a function of the sample temperature (T). One thermocouple is immersed in the sample and, to minimize instrument error, another thermocouple is immersed in a reference material which has no change in heat capacity over the melting point range. The sample and reference material are contained in a temperature regulator which is programmed to heat the sample so as to maintain a constant rate of increase in temperature with time. The melting point is taken at the temperature corresponding to the peak value of dh/dt on the recorded curve of dh/dt vs T. This curve is roughly bell shaped.

Relative viscosity (HRV) is the ratio of the viscosity of a solution of 0.78 gram of a polyester, dissolved in 10 ml of hexafluoroisopropanol containing 100 ppm $H_2SO_4$, to the viscosity of the $H_2SO_4$—containing hexafluoroisopropanol itself, both measured at 25° C. in a capillary viscosimeter and expressed in the same units.

Crimp frequency is determined on filament samples about 20 inches (50 cm) in length. Adhesive tape is used to attach a filament at top and bottom to a clear, plastic straight-edge, so that the filament is in a relaxed condition on the straight-edge. Using a Shadowgraph and about 20× magnification the number of full cycles of crimp in the filament are counted. The extended length of the same filament is then measured under a load sufficient to straighten but not stretch the filament, e.g., a 0.6 g weight for 2 to 6 dpf filaments. The crimp frequency is the number of crimps divided by the extended length.

I claim:

1. A twist-free texturing feed yarn of drawn thermoplastic filaments of about the same denier for providing high contrast heather of low directionality in fabric made from the yarn after it has been false-twist textured; the feed yarn comprising a bundle (A) of 6 to 50 filaments having a melting point of 255° to 275° C., and a bundle (B) of 6 to 50 filaments having a melting point above 230° C. which differs from that of the filaments of bundle (A) by 15° to 39° C.; the filaments of bundle (A) being substantially free of filament intermingling with the filaments of bundle (B) and having a coloration or affinity for dyestuffs different from that of the filaments of bundle (B) for obtaining a high contrast heather in fabrics.

2. A texturing feed yarn as defined in claim 1 wherein the filaments of bundle (A) consist of polymers selected from the group consisting of poly(ethylene terephthalate), poly[ethylene terephthalate/5-(sodium sulfo)isophthalate] containing up to about 2 mole percent of the 5-(sodium sulfo)-isophthalate groups in the polymer chain, and poly(hexamethylene adipamide); and the filaments of bundle (B) consist of a polymer of about 85 to 90 mole percent ethylene terephthalate structural units and about 10 to 15 mole percent of other ester units forming a copolyester therewith.

3. A texturing feed yarn as defined in claim 2 wherein the filaments of bundle (B) consist of poly(ethylene terephthalate/glutarate).

4. A texturing feed yarn as defined in claim 2 wherein the filaments of bundle (B) consist of poly(ethylene/2,2-dimethyl-1,3-propylene terephthalate).

5. A texturing feed yarn as defined in claim 2 wherein the filaments of bundle (B) consist of poly(ethylene terephthalate/adipate.

6. In the process for plying drawn filament bundles of different coloration or affinity for dyestuffs to provide a heather effect in fabric made from the plied yarn, the improvement for producing a textured yarn that provides a high contrast heather of low directionality, which comprises combining a bundle (A) of 6 to 50 drawn filaments having a melting point of 255° to 275° C. with a bundle (B) of 6 to 50 drawn filaments having a melting point above 230° C. which differs from that of the filaments of bundle (A) by 15° to 39° C., the combined bundles forming a texturing feed yarn which is substantially free from twist or intermingling of the two types of filaments, and then false-twist texturing the feed yarn at a temperature 53° to 78° C. lower than the melting point of the filaments of bundle (A) to produce a textured yarn, substantially free from fusion or breakage of filaments, that has twist entrapments alternating with short untwisted sections of yarn along the length of the yarn.

7. A process as defined in claim 6 wherein the filaments of the texturing feed yarn are of about the same denier.

8. A process as defined in claim 7 wherein the filaments of bundle (A) consist of poly(ethylene terephthalate) or poly[ethylene terephthalate/5-(sodium sulfo)isophthalate] containing up to about 2 mole percent of the 5-(sodium sulfo)isophthalate groups in the polymer chain; and the filaments of bundle (B) consist of a polymer of about 85 to 90 mole percent ethylene terephthalate structural units and about 10 to 15 mole percent of other ester units forming a copolyester therewith.

9. A process as defined in claim 8 wherein the texturing feed yarn is false-twist textured at about 710 $D^{-0.5}$ turns per inch at a texturing temperature which causes a high frequency of twist entrapments in the yarn, D being the yarn denier.

* * * * *